US007185699B2

(12) United States Patent
Zazovsky et al.

(10) Patent No.: US 7,185,699 B2
(45) Date of Patent: Mar. 6, 2007

(54) WATER COMPATIBLE HYDRAULIC FLUIDS

(75) Inventors: Alexander Zazovsky, Houston, TX (US); Jian Zhou, Sugar Land, TX (US); Christopher Del Campo, Houston, TX (US); Golchehreh Salamat, Sugar Land, TX (US); Diankui Fu, Missouri City, TX (US); Jese C. Lee, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 408 days.

(21) Appl. No.: 10/709,730

(22) Filed: May 25, 2004

(65) Prior Publication Data

US 2005/0263290 A1 Dec. 1, 2005

(51) Int. Cl.
*E21B 41/00* (2006.01)
*C10M 107/32* (2006.01)

(52) U.S. Cl. ..... 166/244.1; 166/902; 508/579

(58) Field of Classification Search ..... 166/244.1, 166/902; 508/579
See application file for complete search history.

(56) References Cited

U.S. PATENT DOCUMENTS

| | | | | |
|---|---|---|---|---|
| 3,117,929 | A * | 1/1964 | Kluge et al. | 508/162 |
| 3,405,067 | A * | 10/1968 | Fay | 252/75 |
| 3,645,901 | A | 2/1972 | Matson | 252/75 |
| 3,775,319 | A | 11/1973 | Hartmen | 252/33.4 |
| 4,160,063 | A * | 7/1979 | Titus | 428/389 |
| 4,518,512 | A * | 5/1985 | Kanamori | 508/389 |
| 4,946,612 | A | 8/1990 | Kanamori et al. | 252/49.5 |
| 5,048,603 | A * | 9/1991 | Bell et al. | 166/70 |
| 5,135,052 | A * | 8/1992 | Puerto | 166/252.1 |
| 5,807,810 | A * | 9/1998 | Blezard et al. | 507/103 |
| 5,960,878 | A * | 10/1999 | Nguyen et al. | 166/276 |
| 5,964,692 | A * | 10/1999 | Blezard et al. | 516/59 |
| 6,130,190 | A * | 10/2000 | Gunsel et al. | 508/204 |
| 6,273,189 | B1 * | 8/2001 | Gissler et al. | 166/241.1 |
| 6,339,886 | B1 * | 1/2002 | Reinhardt | 33/544.2 |
| 6,436,883 | B1 * | 8/2002 | Nieh | 508/579 |
| 6,461,393 | B1 * | 10/2002 | Krull et al. | 44/385 |
| 6,926,836 | B2 * | 8/2005 | Fidoe et al. | 210/700 |
| 6,997,270 | B2 * | 2/2006 | Mody et al. | 175/50 |
| 2004/0183215 | A1 * | 9/2004 | Fujieda et al. | 257/793 |
| 2005/0037509 | A1 * | 2/2005 | Geisler et al. | 436/164 |

FOREIGN PATENT DOCUMENTS

GB 2 105 365 3/1983

OTHER PUBLICATIONS

Patent Abstracts of Japan—09003472, Publication date—Jan. 7, 1997.

*Amphiphilic Block Copolymers as Efficiency Boosters for Microemulsions*—Langmuir 1999, 15, 6707-6711, B. Jakobs, T. Scottmann and R. Strey.

* cited by examiner

*Primary Examiner*—David Bagnell
*Assistant Examiner*—Shane Bomar
(74) *Attorney, Agent, or Firm*—David Cate; Tim Carington; Robin Nava

(57) ABSTRACT

A composition for use in an oil chamber of a tool includes a hydraulic oil; and a surfactant, wherein the surfactant is present at an amount sufficient to form micelles in the hydraulic oil. The composition may further include an amphiphilic copolymer. A method includes providing a hydraulic fluid composition comprising a hydraulic oil and a surfactant capable of forming micelles in the hydraulic oil; and filling a hydraulic chamber in the tool with the hydraulic fluid composition. The hydraulic fluid composition may further include an amphiphilic copolymer.

16 Claims, 4 Drawing Sheets

WATER COMPATIBLE HYDRAULIC FLUIDS

BACKGROUND OF INVENTION

1. Field of the Invention

This invention relates to hydraulic fluids for the protection of equipment, such as downhole tools used in oil and gas exploration and production. More particularly, this invention relates to hydraulic fluids that can protect tools from adverse effects resulting from water leakage into the tools.

2. Background Art

Hydraulic fluids are used in various tools, including downhole tools used in oil and gas exploration and production. Hydraulic fluids in these tools serve diverse functions including lubrication, force transduction, pressure compensation, and insulation for various electronic components in the tools. For example, electronic components that are critical for safe and functional operations of a tool may be protected in a chamber filled with a dielectric hydraulic oil.

While embodiments of the invention may be applied to various kinds of tools or equipment, the following description uses a downhole tool for illustration. One of ordinary skill in the art would appreciate that the use of a downhole tool is for clarity of illustration and is not intended to so limit the scope of the invention.

FIG. 1 shows a downhole tool 101 disposed in a borehole 102. The downhole tool 101 can be any tool that is used in the drilling, logging, completion, or production of the well, including for example a bottom-hole assembly (which may include various measurement-while-drilling (MWD) or logging-while-drilling (LWD) sensors), formation fluid tester (e.g., the MDT™ tool from Schlumberger Technology Corp, Houston, Tex.), etc. The downhole tool 101 is deployed on a wireline, drill string, TLC or coiled tubing 103.

FIG. 2 shows a section of downhole tool 101 in a working environment. The downhole tool 101 may include, among other things, electronic components 201 protected in an oil-filled chamber 202. The oil-filled chamber 202 is filled with a suitable hydraulic oil 203, such as Exxon Univis J26™. One of ordinary skill in the art would appreciate that the types of oils used are not germane to the present invention and should not limit the scope of the invention. The oil-filled chamber 202 is typically separated from the outside environment by a seal 204, which may be an o-ring, gasket, valve seat, or the like.

Downhole tools may be exposed to high temperatures (up to 250° C.) and high pressures (up to 20,000 psi) in the downhole environment. The high pressures downhole may create a significant pressure overbalance relative to hydraulic pressures inside the downhole tools. Such pressure overbalance may lead to leakage of wellbore fluids into the tool hydraulic sections. In addition, the high temperatures in the downhole environment may cause the seal to fail. Either of these conditions may result in leakage 205 of borehole fluid into the oil-filled chamber 202. The borehole fluid may include significant amounts of water. The water leaked into the oil-filled chamber may become droplets entrained 206 in the oil 203. The entrained water will eventually settle to the lowest part of the oil-filled chamber 202, shown as water 207. The entrained water 206 or the settled water 207 may provide conductive paths which cause a short in the electronic components 201.

In addition to causing shorts in electronic components, the water trapped in oil chambers may also degrade components that are not designed to be exposed to water, particularly at the high temperatures and high pressures found downhole. For example, polyimides are often used as insulating materials for electronic components in a downhole tool. Polyimides may be hydrolyzed by water under high temperature and high pressure conditions. Similarly, long term exposure to the trapped water may lead to corrosion of metal parts. Any of these adverse effects will eventually result in tool failure or malfunction, which is costly and may present a safety hazard.

An approach to prevent damage from water collected at the bottom of the oil-filled chamber is to add a higher density dielectric fluid, such as FC-70 (Fluorinert™ from 3M Specialty Materials of St. Paul Minn.), to the hydraulic oil. However, such additives (e.g., Fluorinert™) are often found to negatively affect the performance of the hydraulic fluids in the tool. Also, this approach is dependent on tool orientations, and may not work in deviated well conditions.

Other approaches to avoid the adverse effects of water leakage into a tool include identification of potential leakage locations and then engineering the tool to minimize the risk of leaks occurring at these locations. However, this approach is not always foolproof.

Therefore, there exists a need for further methods to reduce or eliminate the adverse effects of water leakages into the oil-filled chambers in the downhole tools.

SUMMARY OF INVENTION

One aspect of the invention relates to compositions for use in oil chambers of tools. A composition in accordance with one embodiment of the invention includes a hydraulic oil; and a surfactant, wherein the surfactant is present at an amount sufficient to form micelles in the hydraulic oil. The composition may further include an amphiphilic copolymer.

One aspect of the invention relates to tools having hydraulic oils that can avoid adverse effects of water leaking into hydraulic chambers. A tool in accordance with one embodiment of the invention includes a hydraulic chamber; and a hydraulic fluid enclosed in the hydraulic chamber, wherein the hydraulic fluid comprises a hydraulic oil and a surfactant, wherein the surfactant is present at an amount sufficient to form micelles in the hydraulic oil. The hydraulic fluid may further include an amphiphilic copolymer.

One aspect of the invention relates to methods for protecting a tool. A method in accordance with one embodiment of the invention includes providing a hydraulic fluid composition comprising a hydraulic oil and a surfactant capable of forming micelles in the hydraulic oil; and filling a hydraulic chamber in the tool with the hydraulic fluid composition. The hydraulic fluid composition may further include an amphiphilic copolymer.

Other aspects and advantages of the invention will be apparent from the following description and the appended claims.

DETAILED DESCRIPTION

Embodiments of the invention relate to compositions and methods for avoiding or minimizing problems associated with water leakage into hydraulic chambers of tools. Embodiments of the invention may be used by themselves or be used together with other solutions known in the art for avoiding adverse effects due to water leakage into the tools. Embodiments of the invention are based on the ability of certain surfactants (detergents) to form inverted micelles in the hydraulic oils. Note that the terms surfactant and detergent are used interchangeably in this description. Surfactants have been used in the prior art to provide cleaning action (e.g., in gasoline for cleaning of carburetor). Such uses often involve relatively small amounts of the surfactant additives. In contrast, embodiments of the present invention relate to the use of sufficient amounts of the surfactants to form micelles in hydraulic fluids for water sequestration. These micelles will form microemulsions when they encounter water. In this use, the surfactants are provided in amounts above the critical micelle concentrations of the surfactants. In some embodiments, the surfactants are used at concentrations of at least about 1% by volume, preferably at least about 10% by volume.

The inverted micelles formed in the hydraulic oils have internal hydrophilic phases and external hydrophobic shells. The internal hydrophilic phase of the micelles is formed by the hydrophilic head groups of the surfactant molecules, while the outer shell of the micelles are formed of hydrophobic tails of the surfactant molecules. The internal hydrophilic phase can sequester water that has leaked into the hydraulic oil chambers, while the hydrophobic shell helps the micelles "dissolve" in the hydraulic oils (i.e., avoid phase separation).

Figure 1:
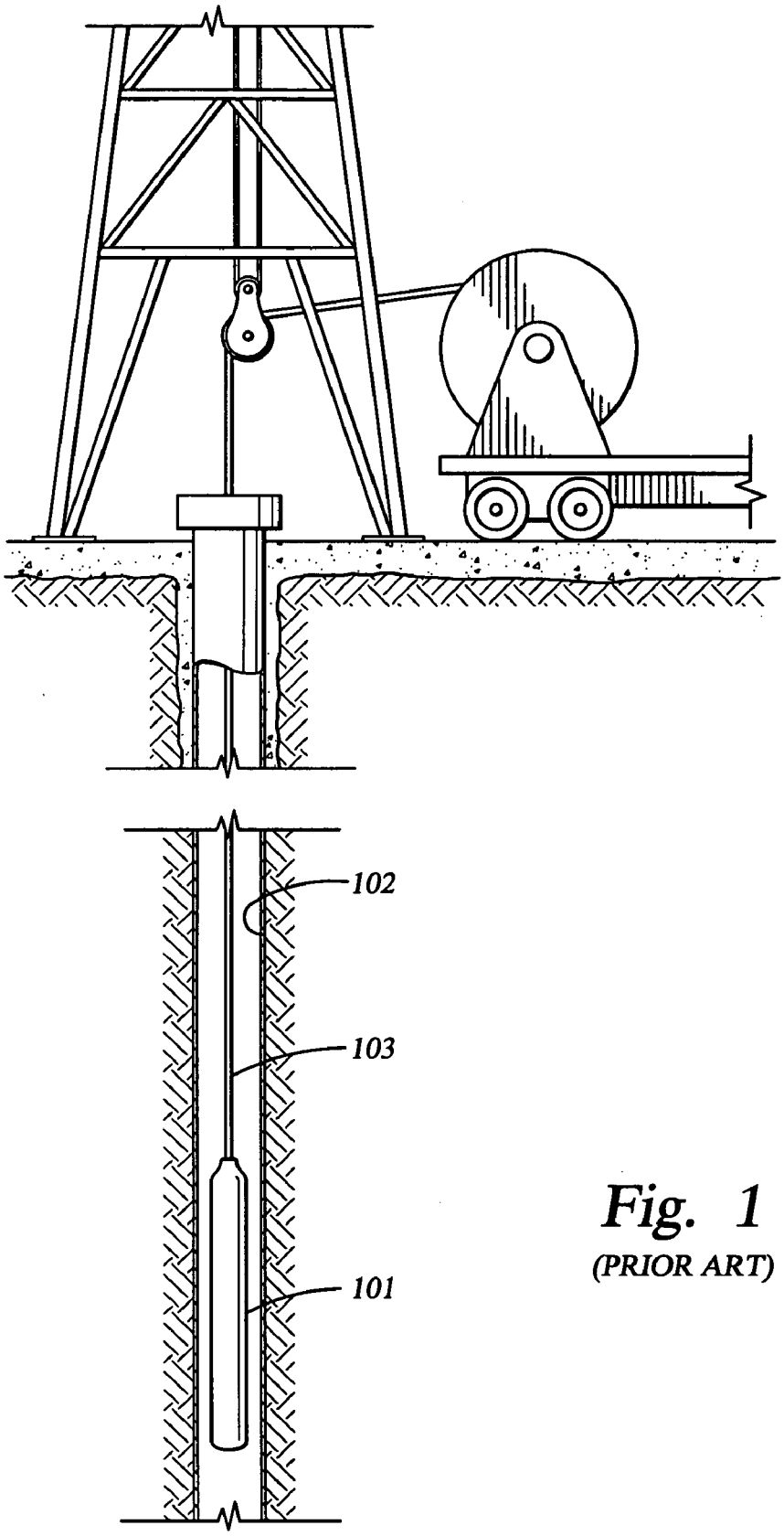
Fig. 1 (PRIOR ART)
FIG. 1 shows a conventional drilling system having a downhole tool disposed in a borehole.
Figure 2:
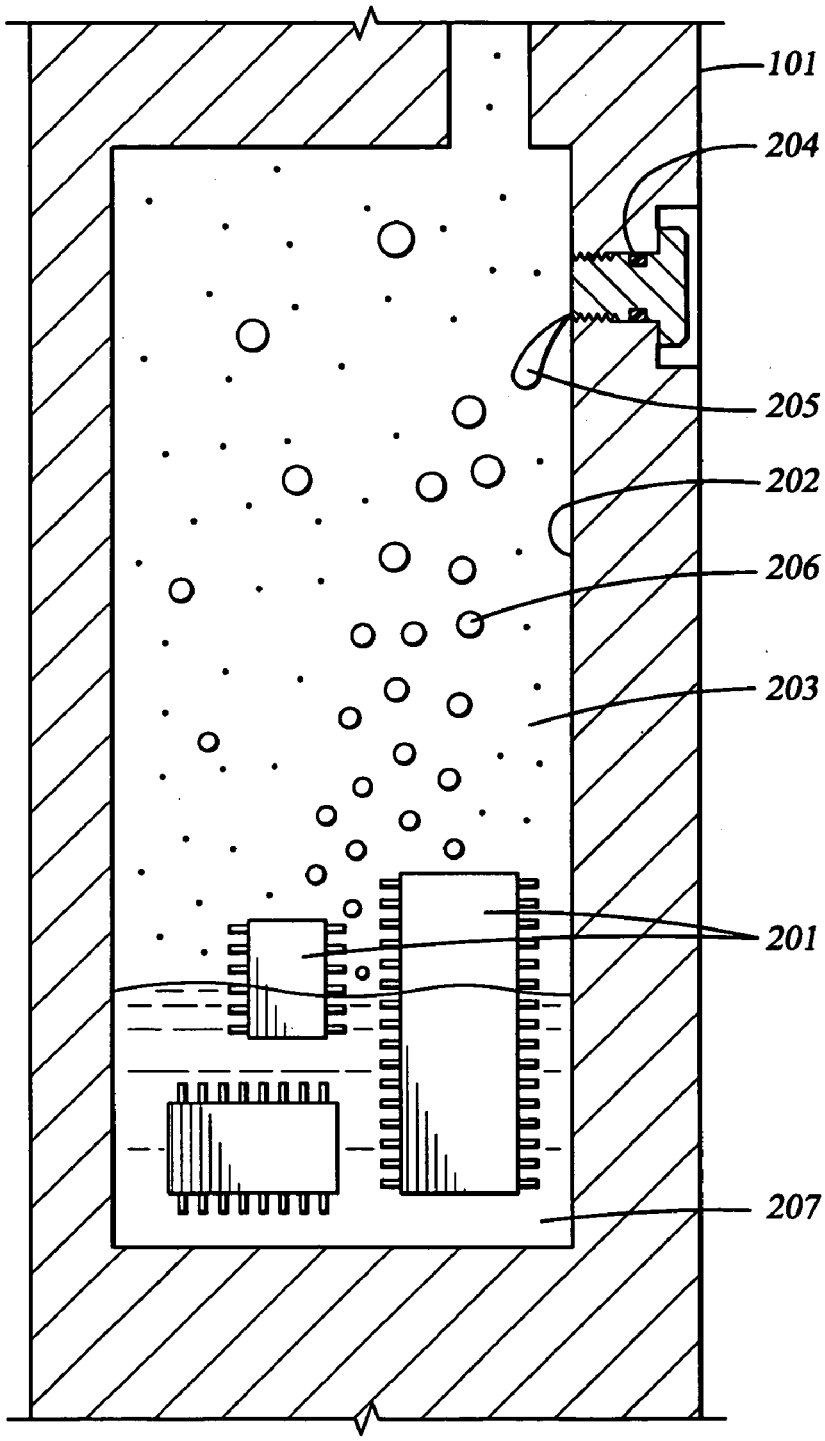
Fig. 2 (PRIOR ART)
FIG. 2 shows a section of a downhole tool having a hydraulic chamber including hydraulic oil that protects electronic components inside the tool.
Figure 3:
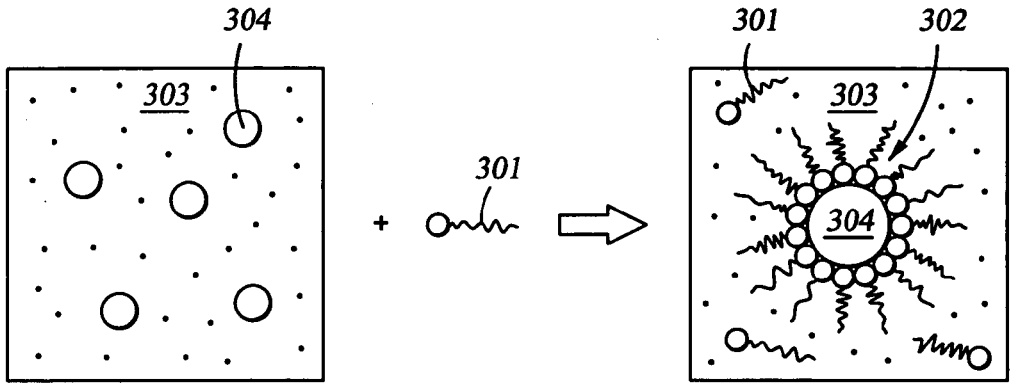
FIG. 3 illustrates the formation of micelles from a surfactant in accordance with one embodiment of the invention.

FIG. 3 shows a schematic of micelle formation from surfactant molecules 301. The surfactant molecules form a micelle 302 in the oil 303. The hydrophilic head groups of the surfactant molecules form a hydrophilic internal phase of the micelle 302, while the hydrophobic tails of the surfactant molecules form a hydrophobic shell that interacts with the oil. The hydrophilic internal phase of the micelle sequesters the water 304 that leaked into the oil chamber, preventing the water droplets from freely floating in the oil. As shown, the hydrophobic "shells" of the micelles also prevent the formation of a continuous water phase in the oil volume; this in turn prevents the formation of an electrically conductive path between electrical components. Thus, failures due to electrical shorting can be prevented. In addition, because the water trapped in the oil chambers is sequestered in the micelles, tool components that otherwise may be degraded (e.g., polyimide insulating materials) or become corroded (e.g., metal parts) by the trapped water are also protected.

A method in accordance with embodiments of the invention allows sequestration of a certain volume of water regardless of its origin making tool operation more reliable. The amount of water that can be sequestered depends on the amount and the type of the surfactants and polymer, the type of oils, and certain environmental factors (e.g., temperature). It is possible that over the long run the amount of leaked water may exceed the sequestering capacities of the micelles. Therefore, it is advisable that the tools be periodically inspected, and the oil should be replaced once the trapped water phase has reached a certain critical level.

An appropriate surfactant, when added to the hydraulic oil, can form micelles with an internal hydrophilic phase and an external hydrophobic phase. The micelles thus formed are stable in the oil such that they will not aggregate and separate from the oil. In preferred embodiments of the invention, the surfactants are those which can form microemulsions. A microemulsion forms a thermodynamically stable homogeneous oil that will not separate out over time.

The structure of a surfactant molecule capable of creating micelles of the type described above includes two distinguishable parts: a hydrophilic head group having an affinity for water and a hydrophobic tail having an affinity for oil or hydrophobic compounds. Examples of suitable surfactants include ionic surfactants and non-ionic surfactants. Ionic surfactants may include, for example, didodecyldimethylammonium bromide (DDAB), sodium bis-(2-ethylhexyl) sulfosccinate (AOT), dodecyltrimethyl ammonium bromide (DTAB), sodium dodecyl sulfate (SDS), and non-ionic detergents may include, for example, polyoxyethylenated alkyl phenols, polyoxyethylenated straight chain alcohols, polyoxyethylenated polyoxypropylene glycols, polyoxyethylenated mercaptans, long chain carboxylic acid esters (e.g., glyceryl and polyglyceryl esters of natural fatty acids), propylene glycol, sorbitol, and polyoxyethylenated sorbitol esters, polyoxyethylene glycol esters, alkanolamines (diethanolamine-, isopropanolamine-fatty acid condensates), and esters based on glycerol, sorbitol, and propylene glycol.

These surfactants can form inverted micelles in the oil. However, if the concentration of the surfactant in oil is insufficient, the surfactant molecules do not aggregate into micelles. Instead the surfactants are dissolved in the oil as monomers or lower oligomers. Beyond a minimum critical concentration, which is unique for each surfactant, the surfactant molecules aggregate to form micelles. The critical concentration above which micelles can form is referred to as the critical micelle concentration (CMC), which relates to inherent properties of each surfactant. One of ordinary skill in the art would know that the CMC for a particular surfactant may also depend on other factors in the system. For example, addition of amphiphilic block copolymers, which is described later, can significantly reduce the concentration of the surfactant required to form microemulsions. Accordingly, CMC as used in this description depends on the system of interest. However, when a particular system is selected, one of ordinary skill in the art would appreciate that the CMC for the particular system can be readily determined.

Figure 4:
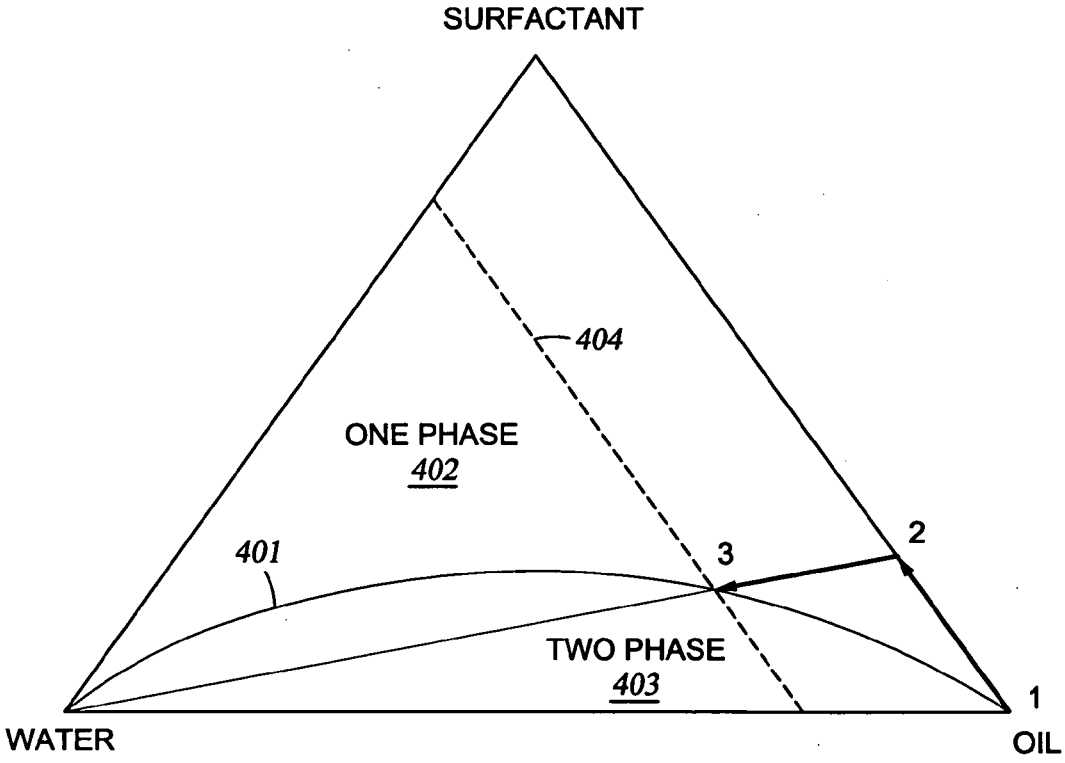
FIG. 4 shows a phase transition diagram of a water-oil-surfactant system in accordance with one embodiment of the invention.

The amount of water that can be absorbed into the internal phase of the micelles depends on the phase behavior of the micellar solution. FIG. 4 shows a typical ternary diagram of the system consisting of water, oil, and a surfactant. The vertices of the triangle correspond to the pure components, i.e. water, oil, and surfactant. As shown, curve 401 depicts the phase change boundary where one-phase region 402 meets the two-phase region 403. In the one-phase region 402, water and oil form a homogeneous phase due to the presence of the surfactant, while in the two-phase region 403, water and oil phases are distinct because the amount of surfactant is insufficient. Note that the location of curve 401 depends on several factors, including the type of surfactant and the type of oil in the system.

FIG. 4 also illustrates a phase transition of the water-oil-surfactant ternary system. When a surfactant is added to pure oil at point 1, the mixture has a composition illustrated at point 2, which is a homogeneous single phase. This mixture may gradually pick up water (e.g., water leaking into the oil chamber) and eventually reach point 3, at which the capacity of the surfactant (micelles) to sequester water is saturated. If more water enters the system, the mixture transitions to two phases because the water sequestering capacity of the micelles is exceeded. Thus, the dotted line 404, which passes through the point 3 parallel to the side "Surfactant—Oil," indicates the maximum amount of water that can be sequestered by this particular system. One of ordinary skill in the art would appreciate that the quantitative characteristics of this phase behavior depends on the temperature, salinity, type of hydraulic oil, type of surfactant, and concentration of the surfactant, among other things. Further, those having ordinary skill in the art will recognize that in the downhole environment, the water may contain other compounds that might affect that amount of water that can be sequestered by a particular system.

The first step of solubilization of a water-in-oil surfactant mixture is achieved by "trapping" water in the core of micellar structure. When the amount of water reaches certain level, a small droplet of water is formed, and a water-in-oil microemulsion is formed. During this process, a transparent and thermodynamically stable suspension of emulsion with small diameters (e.g., in the 10–100 nm range) is formed. These emulsions may include microemulsions and/or macroemulsions. The capability and the form of microemulsion or macroemulsion depend on the property of surfactant systems, especially the hydrophile-lipophile balance (HLB) values of the surfactants. It was found that the maximum capacity of water solubilization can be achieved with an HLB in the range between 8.5 and 11 for the formation of water-in-oil microemulsion. This range is much different from that of macroemulsions. Water-in-oil macroemulsions are expected to form for surfactant mixtures in the HLB 3–6 range, while oil-in-water macroemulsions generally form in the HLB 10–18 range. Preferred embodiments of the invention use surfactants having an HLB in the range of about 8.5 to about 11 for the formation of microemulsions.

The water-in-oil microemulsions are thermodynamically stable and will not separate out from the solution over time. However, water-in-oil microemulsions generally have lower capacities to sequester water than water-in-oil macroemulsions. Nevertheless, some systems can form microemulsions with water-to-oil volume ratios of over 40%. The transition from a clear to a cloudy solution is an indication that the maximum capacity for water "solubilization" has been exceeded. In addition, the rates of water solubilization decrease as the system approaches the maximum water solubilization capacity. Thus, either the appearance of cloudiness or the slow rates of water solubilization can be used as an indication that the oil-surfactant system in a downhole tool needs replacement.

Embodiments of the invention will be further described using the following working examples.

EXAMPLE 1

In accordance with one embodiment of the invention, a formulation is prepared for coil-tubing operations. Various non-ionic surfactants may be used for the formulation. Examples of the non-ionic detergents include POLYSTEP F-1™ and POLYSTEP F-3™ available from Stepan Co. (Northfield, Ill.). These surfactants are soluble in most hydraulic oils, such as Aeroshell 560 Turbine oil from Shell Lubricants (Houston, Tex.), and can form a clear solution without a noticeable visual property change to the hydraulic oils.

One way to assess the ability of the detergent to sequester water is by conductivity measurements while adding water to the system. The conductivity measurement of the solution (5% by volume POLYSTEP F-1™+5% by volume POLYSTEP F-3™ in Aeroshell 560™ turbine oil) with additional water solution are shown in the following table:

TABLE 1

The Conductivity Of The Fluid System (μS/Cm) With Addition Of Different Water Phase.

| Water solution tested | 1% water phase | 2% water phase | 3% water phase | 4% water phase | 5% water phase | 8% Water phase |
|---|---|---|---|---|---|---|
| Tap water | <0.1* | <0.1 | <0.1 | <0.1** | <0.1** | <0.1*** |
| 2% KCl | <0.1 | <0.1 | <0.1 | <0.1** | 18** | <0.1*** |
| 0.67% $CaCl_2$, 0.2% $MgCl_2$, 24% NaCl, 0.02% $NaHCO_3$ (formation water) | <0.1 | <0.1 | <0.1 | <0.1** | <0.1** | <0.1*** |
| 1% NaCl | <0.1 | <0.1 | <0.1 | <0.1** | 8.1** | <0.1*** |
| 5% NaCl | <0.1 | <0.1 | <0.1 | <0.1** | <0.1** | <0.1*** |
| 10% NaCl | <0.1 | <0.1 | <0.1 | <0.1** | <0.1** | <0.1*** |
| 15% NaCl | <0.1 | <0.1 | <0.1 | <0.1** | <0.1** | <0.1*** |
| 20% NaCl | <0.1 | <0.1 | <0.1 | <0.1** | <0.1** | <0.1*** |

*The limit of the conductivity test instrument is 0.1 μS/cm.
**Starting of macroemulsion formation.
***Macroemulsion.Reference: Sugar Land tap water, 560 μS/cm; water solution containing 2% KCl, 31,000 μS/cm.

An important aspect of the invention is that a surfactant-oil system can take up a certain amount of water without forming conducting fluid, thus reducing the chance of short-circuit due to higher conductivity of water. Table 1 clearly shows that the surfactant-oil system can tolerate a substantial amount of water. Based on the results shown in Table 1, this surfactant-oil system was able to sequester up to 3% water by the formation of microemulsions, regardless of the types of water (i.e., any concentration of salts). With more than 3% water, the system could still sequester the water, but by the formation of macroemulsions.

Further tests show that at low concentrations of water, the water/oil/surfactant mixture remains a homogenous microemulsion solution and is not conductive (<0.1 μS/cm). When the contents of water increase to 4%, the mixture starts to form a macroemulsion, and some conductivity is observed during this transition. However, the conductivity of the mixture is still less than 0.1% of the conductivity of the water solution added, indicating that the system is still effective in sequestering water. Further addition of water will result in the formation of macroemulsions, and the conductivity of the system decreases again. By proper selection of surfactants, a surfactant-oil system may be designed to accommodate higher contents of water.

Figure 5:
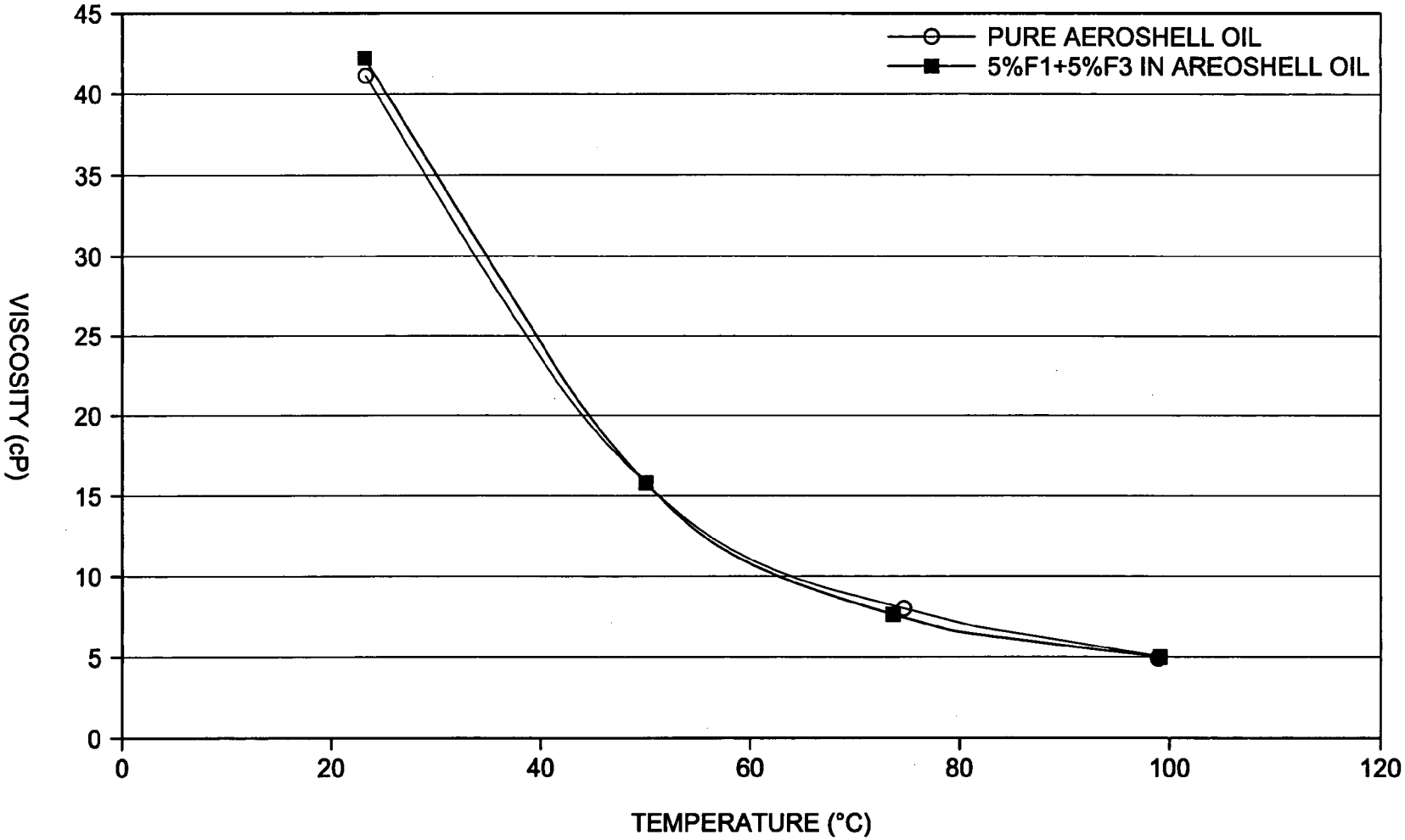
FIG. 5 shows viscosity tests at various temperatures of an oil-surfactant system in accordance with one embodiment of the invention as compared with the corresponding oil.

In accordance with preferred embodiments of the invention, the oil-surfactant formulations should not change the properties of the hydraulic oils, especially the viscosity of the fluid. FIG. 5 shows the rheological measurements of a system comprising Aeroshell 560™, 5% POLYSTEP F-1™, and 5% POLYSTEP F-3™ in accordance with one embodiment of the invention. It is clear that the viscosity of this surfactant-oil blend (curve 51) is essentially the same as the original oil (curve 52). Further tests shows that the blend has similar rheological characteristics as the pure oil at low temperatures (−40° C., −30° C., and 10° C.). Furthermore, as measured by rheological instruments, the expansion coefficients of this blend are also similar to the original oil. Therefore, it is expected that a surfactant-oil system in accordance with embodiments of the invention will not degrade the performance (or interfere with the intended functions) of the hydraulic oils.

A lab test of the above Aeroshell/surfactant mixture in a downhole tool for an extended period of time was performed to determine whether there are any long-term incompatibilities between the mixture and the internal components of the tool. The tool was loaded with approximately 2.0 liters of the mixture and then run on tool stands. The test duration was 13 hours and the distance "tractored" was 24,000 ft. This is equivalent to approximately 5 jobs in the field. No failures or malfunctions of the tool were observed during this test.

EXAMPLE 2

A second formulation was prepared for coil-tubing operations, using commercial products, such as POLYSTEP TD-3™ and POLYSTEP TD-6™ from Stepan Co. These surfactants are soluble in Aeroshell 560™ Turbine oil and form a clear solution without any noticeable visual property change. Conductivity measurements of the solution (5% POLYSTEP TD-3™+5% POLYSTEP TD-6™ in Aeroshell 560™ turbine oil) show that the resulting fluid does not have measurable conductivity with the addition of up to 8% tap water. Thus, this formulation is capable of protecting the downhole electronic components from shorts caused by water leakage into the hydraulic chambers.

EXAMPLE 3

A third formulation was prepared for wireline downhole tools. The surfactants used are commercial products, such as POLYSTEP F-1™ and POLYSTEP F-3™ from Stepan Co. These surfactants are soluble in the hydraulic oil J26™ from Exxon and form a clear solution without a noticeable visual property change. The conductivity measurement of the solution gives a reading of less than 1 μS/cm, while water gives 550 μS/cm. This result shows that this formulation is quite effective at sequestering water.

In order to assess the capability of the above formulation to dissolve water, tests were carried out by adding different amounts of water into different test tubes, each containing 20 ml of a test mixture. The fluid remained clear with the addition of 0.5 ml (2.5%) water and its conductivity remained the same as pure oil. The addition of 1 ml (5%) of water resulted in a slightly cloudy solution, indicating the potential formation of macroemulsions. However, there was no indication of increases in conductivity. The addition of 2 ml (10%) of water resulted in a cloudy solution, indicating the formation of macroemulsions.

To test the stability of the surfactant-oil systems containing water in accordance with embodiments of the invention, these samples were kept in a 170° F. oven over a period of one week. The sample containing 2.5% of water remained clear, while the other samples started to separate into two phases. Both phases are non-conductive and remain clear after being allowed to cool down to room temperature, indicating that both phases are microemulsions of water, but with different concentrations of either surfactants, or water, or both.

The ability of a surfactant-oil system in accordance with embodiments of the invention to protect a tool from corrosion caused by water was tested by placing a carbon steel part in a solution comprising Aeroshell 560™, 10% POLYSTEP F-1™ and 10% POLYSTEP F-3™ in a Teflon™ cup in a mud bomb (a stainless steel pressure vessel) and heated to 300° F. for up to 7 days. The results of these tests are summarized in Table 2:

TABLE 2

| Corrosion Tests (Relative weight loss in 7 days at 300° F. compared to pure oil (rate = 1) | | | | |
|---|---|---|---|---|
| | Pure Oil | Oil + surfactant | Oil + surfactant + 1% Water | Oil + 1% Water |
| Relative weight loss over 7 days at 300° F. | 1 | 0 | 0.7 | 2.6 |

It is clear from Table 2 that the surfactant helps protect the carbon steel from corrosion caused by the salt water. These results indicate that the surfactant-oil systems in accordance with embodiments of the invention can effectively prolong the service lives of downhole tools.

Some embodiments of the invention relate to the use of surfactants and copolymers to sequester water in oils. As noted above, amphiphilic block copolymers are known to boost the efficiencies of microemulsion formation in the water-oil-surfactant systems. Microemulsions are thermodynamically stable dispersions of water, oils, and surfactants. The thermodynamic stability of a microemulsion system results from the balance between a low positive interfacial energy and a negative entropy of dispersion, which produce a zero or negative net free energy for the formation of the microemulsion. Amphiphilic copolymers can dissolve in oil-continuous microemulsions (i.e., inverted microemulsions) with the hydrophilic parts immersed in the water droplets and the hydrophobic parts in the oil phase. In this manner, the amphiphilic copolymers can stabilize the microemulsions. As a result, lower concentrations of surfactants are required to form microemulsions and the resultant microemulsions are more thermodynamically stable.

While any suitable amphiphilic copolymers may be used in conjunction with the present invention, the following copolymers are preferred: poly(dodecyl methacrylate) poly (ethylene glycol) copolymer and poly(dimethylsiloxane) poly(ethylene oxide) copolymer.

While the above description uses a single surfactant to illustrate embodiments of the invention, one of ordinary skill in the art will appreciate that a mixture of two or more surfactants may also be used. In addition, the surfactant(s) may be used with or without one or more amphiphilic copolymers.

Advantages of embodiments of the invention may include the following: a method in accordance with the invention can effectively prevent electrical shorting between electric components of a downhole tool protected in a hydraulic oil or turbine oil chamber. This method is based on adding appropriate surfactants into the conventional hydraulic oils (e.g., J26™ hole tools or Aeroshell™ turbine oil for coil tubing tools). A microemulsion is created when water or a brine solution is added to the oil/surfactant mixture. These oil/surfactant blends are capable of absorbing (solubilizing) water leaking into the hydraulic oil chambers. A surfactant-oil system in accordance with embodiments of the invention can protect the electronic components and prevent corrosion in the tools without compromising the performance of the hydraulic oils. Accordingly, embodiments of the invention can prolong the service life of a downhole tool.

Note that the advantages of the invention may also be realized in tools other than downhole tools. One of ordinary skill in the art would appreciate that any tool that uses a hydraulic fluid may benefit from a hydraulic fluid composition in accordance with embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A tool, comprising:

a hydraulic chamber; and, a hydraulic fluid enclosed in the hydraulic chamber, wherein the hydraulic fluid comprises a hydraulic oil and a surfactant, wherein the surfactant is present at an amount sufficient to form micelles in the hydraulic oil and prevent the hydraulic fluid from forming an electrically conductive path.

2. The tool of claim 1, wherein the hydraulic fluid further comprising an amphiphilic copolymer.

3. The tool of claim 1, wherein the tool is a downhole tool.

4. The tool of claim 1, wherein the downhole tool is one selected from the group consisting of a formation fluid tester, a downhole logging tool, a downhole sensor, a downhole tractor, an offshore seismic sensor, a submerged monitor and sensor system.

5. The tool of claim 1, wherein the surfactant comprises at least 1% by volume of the composition.

6. The tool of claim 5, wherein the surfactant comprises at least 10% by volume of the composition.

7. The tool of claim 1, wherein the surfactant is a non-ionic surfactant selected from the group consisting of polyoxyethylenated alkylphenols, polyoxyethylenated alcohols, polyoxyethylenated polyoxypropylene glycols, polyoxyethylenated mercaptans, and long chain carboxylic acid esters.

8. The tool of claim 1, wherein the surfactant is an ionic surfactant selected from the group consisting of sodium bis(2-ethylhexyl) sulfosccinate (AOT), didodecyldimethylammonium bromide (DDAB), dodecyltrimethyl ammonium bromide (DTAB), and sodium dodecyl sulfate (SDS).

9. The methd of claim 1, wherein the surfactant comprises at least 10% by volume of the composition.

10. A method for protecting a tool, comprising:

providing a hydraulic fluid composition comprising a hydraulic oil and a surfactant capable of forming micelles in the hydraulic oil, wherein the surfactant prevents the hydraulic fluid from forming an electrically conductive path; and, filling a hydraulic chamber in the tool with the hydraulic fluid composition.

11. The method of claim 10, wherein the tool is a downhole tool.

12. The method of claim 11, wherein the downhole tool is one selected from the group consisting of a formation fluid tester, a downhole tractor, a downhole logging tool, and a downhole sensor.

13. The method of claim 10, wherein the surfactant comprises at least 1% by volume of the composition.

14. The method of claim 10, wherein the surfactant is a non-ionic surfactant selected from the group consisting of polyoxyethylenated alkyiphenols, polyoxyethylenated alcohols, polyoxyethylenated polyoxypropylene glycols, polyoxyethylenated mercaptans, and long chain carboxylic acid esters.

15. The method of claim 10, wherein the surfactant is an ionic surfactant selected from the group consisting of sodium bis(2-ethylhexyl) sulfosccinate (AOT), didodecyldimethylammonium bromide (DDAB), dodecyltrimethyl ammonium bromide (DTAB), and sodium dodecyl sulfate (SDS).

16. The method of claim 10, wherein the surfactant further prevents electrical shorting of the tool.

* * * * *